United States Patent [19]

Safar

[11] 3,986,329

[45] Oct. 19, 1976

[54] APPARATUS FOR DIRECTING FIBERS IN OPEN END SPINNING MACHINES

[75] Inventor: Vaclav Safar, Liberec, Czechoslovakia

[73] Assignee: Elitex, Zavody textilniho strojirenstvi generalni reditalstvi, Liberec, Czechoslovakia

[22] Filed: Nov. 13, 1974

[21] Appl. No.: 523,441

[52] U.S. Cl. ..... 57/58.95
[51] Int. Cl.[2] ..... D01H 1/12
[58] Field of Search ..... 57/58.89, 58.95, 156

[56] References Cited

UNITED STATES PATENTS

| | | | |
|---|---|---|---|
| 3,584,451 | 6/1971 | Chrtek et al. | 57/58.95 |
| 3,688,487 | 9/1972 | Fukuta et al. | 57/58.95 |
| 3,703,074 | 11/1972 | Staneff | 57/58.95 |

*Primary Examiner*—Richard C. Queisser
*Assistant Examiner*—Charles Gorenstein

[57] ABSTRACT

An open end spinning device having a rotating chamber to which discrete fibers are fed and in which the fibers are spun into a continuous yarn which is removed from the chamber. The fibers are supplied through a duct formed in a parallelpiped body, which duct is directed at the opening of the spinning chamber. The fibers are engaged and deflected with respect to the direction of rotation of the spinning chamber by means interposed between the duct and the chamber so that each fiber is braked at its rear end and caused to enter the chamber in an elongated fashion oriented with respect to each of the other fibers.

8 Claims, 10 Drawing Figures

Fig-4
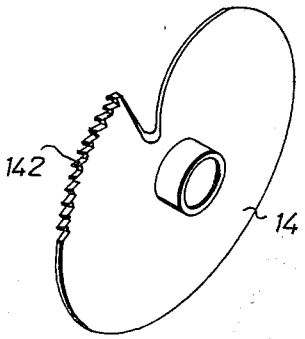
Fig-5
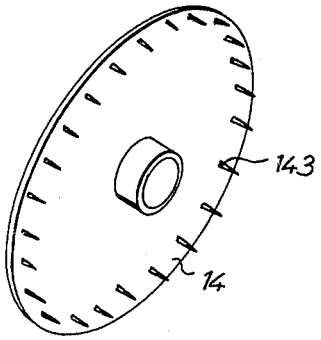
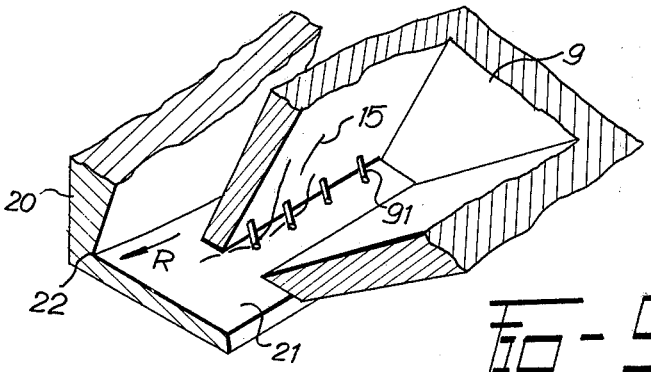
Fig-9
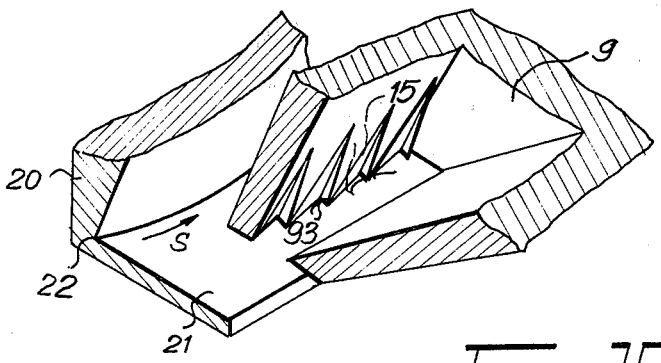
Fig-10

APPARATUS FOR DIRECTING FIBERS IN OPEN END SPINNING MACHINES

BACKGROUND OF THE INVENTION

The present invention relates to the supply of fibers to the spinning chamber of an open end spinning device and in particular to a method and apparatus for directing the flow of fibers so that the fibers are uniformly oriented on the collecting surface.

Conventional open end spinning units comprise a rotatable turbine having a rear wall and a continuous radially inwardly inclined side wall forming a cuplike chamber and defining a fiber collecting surface. Fibers are fed to the chamber through a duct or passage, formed in a supporting body, after being separated from a continuous roving or string. The fibers are centrifugally flung onto the collecting surface and the yarn is withdrawn in a path along the axis rotation of the chamber.

The direction of the fibers into the collecting surface may be obtained by positioning the opening or mouth of the feed duct or channel adjacent the side wall and by directing the opening in line with the collecting surface or by providing separator or divider means interposed between the end of the channel and the chamber. In either instance, it is helpful to allow the fibers to slide over the side wall, since a twofold benefit might be obtained. On the one hand, it serves to maintain separation of the infeed fibers from the spun yarn as the yarn is being withdrawn, and on the other hand, it provides a straightening of the fibers by their frictional action in sliding on the inclined surface. This latter action is supplemented by the cooperative flow of air through the duct and chamber which also serves to accelerate the fibers leaving the duct and entering the chamber.

In any event, the known spinning units, whether using a separate divider as a directing means or not, have the defect in that the fibers actually entering the chamber are not uniformly directed or oriented but are in fact heterogeneously flung into the chamber in an uncontrolled state, being further acted upon by the adverse frictional engagement with the side wall over which they slide. A second defect lies in the fact that the acceleration of the fibers during their passage from the duct into the chamber, by the action of the air flow, further causes the fibers to slide on the inclined side wall in an uncontrolled and unbraked condition.

The foregoing defects have serious consequences in the formation of the yarn, since the operational characteristics of rotary spinning chambers depend substantially upon an even distribution and straightening of the fibers on to the collecting surface. The straightening of the fibers has a decisive influence on the ultimate strength and tensil property of the obtained yarn. The more the fibers on the collecting surface of the spinning chamber are straightened, the easier the fibers may be spun and twisted into the yarn ribbon. In addition to strengthening the yarn thus produced, the easier the fibers are twisted into the yarn ribbon, the fewer the number of yarn breakages during the spinning process. It has been generally accepted that yarns made in the rotating spinning chamber of open end spinning machines are of lower strength than yarns made of the same material in conventional ring spinning machines. It has also been accepted that the fibers in the yarn which is made in open end spinning machines are more creased, i.e.: curled, and therefore of relatively shorter length than the same fibers spun into yarn by other methods.

It is the prime object of the present invention to overcome the disadvantages and defects of the prior art as enumerated above and provide a yarn, made by the open end spinning process, which has comparable strength and longer length fibers to those made in other processes.

The prime reason for the enumerated disadvantages inherent in open end spinning units consists in the low efficiency of the frictional force created between the fiber and the sliding wall of the spinning chamber, for straightening of the fibers. Fibers deposited on the inclined wall are subjected to the action of centrifugal forces which are greater than the frictional forces so that the fibers are quickly accelerated to a circumferential speed which approaches the circumferential speed of the collecting surface and which cause the fibers to quickly slide on the inclined wall onto the collecting surface. The fibers form a fibrous ribbon which is twisted by the action of rotation of the spinning chamber and which becomes wrapped on to the end of the already finished yarn, thus forming the continuous yarn without the individual fibers becoming straightened.

In the known conventional spinning units the fibers are deposited on the side wall of the rotating spinning chamber, which is usually of conical shape so that both the front and the rear ends of the fiber are deposited along approximately the same diametrical line of the inclined side wall, i.e.: on a certain contour plane parallel to the collecting surface of the spinning chamber. Thus, a centrifugal force acts uniformly on the entire length of the fiber, the force being equal value at both the front and rear end of the fiber. Thus, it depends solely on random conditions and random influences as to which of the fiber ends is to be accelerated with a greater force in the direction of the circumferential speed of the spinning chamber. The effect of a higher acceleration on the front end of the fiber is favorable since it will tend to straighten the fiber. However, in the opposite case, that is the effect of the higher acceleration on the rear end of the fiber, an undesirable curling and creasing of the fiber occurs and the fiber is deposited in an undesireable condition on the collecting surface. As a result of this latter condition, the phenomena, previously mentioned, occurs, having very unfavorable influence upon the property of the yarn being manufactured.

Because centrifugal forces act on both the front and rear end of the fibers simultaneously, the deposition of the fibers on the inclined wall, without first directing and orienting them with respect to their flow path, results in a nonuniform movement of the fibers in the radial direction on the inclined side wall. That is, the fibers move randomly in a nonuniform curve on the inclined surface toward the collecting surface.

The deposition of fibers on to the inclined or side wall, without orientation or proper direction, results in the movement of the individual fibers heterogeneously and in random manner, in the radial direction over the side wall, i.e.: in a spiral curve, toward the collecting surface. Thus, which end of the fiber is actually deposited first on the collecting surface depends upon the local and random conditions on the portion of the slide wall with which the fiber first makes contact. Such conditions as the surface roughness, its contamination with dirt, and flow of actual air over the surface are factors entering into the movement of the fibers. At the moment the fibers are deposited onto the collecting surface, the fiber has as yet not accelerated by the frictional forces acting between it and the inclined surface so as to attain the circumferential speed of the collecting surface. It only asymptotically approximates such speed. The collecting surface has frictional properties which are completely different from those of the inclined sliding wall, particularly because of the accumulation of dust and impurities thereon. A substantial influence upon the collection of the fibers on the collecting surface is also exerted by the existence of any incomplete ribbon or yarn remaining on the collecting surface.

When the front end of the fibers reach the collecting surface first, an intensive circumferential acceleration takes place by action of an increased entraining force, causing a straightening of the fibers at the moment at which it is deposited on the collecting surface. However, when the fiber reaches the collecting surface with its rear end first, as a result of the above indicated random influences and conditions, then the fiber is undesireably creased and curled onto the collecting surface, resulting in the detailed defects in the formation of the yarn ribbon as mentioned above.

It is the object of the present invention to provide an improved open end spinning process in which yarn is produced having greater strength and thereby increase the utility and application.

It is a further object of the present invention to improve the control and movement of fiber flow from the feed channel into the spinning chamber so that the fibers are deposited onto the collecting surface with a greater degree of orientation and direction then heretofore so as to provide a more uniform continuous yarn.

It is a further particular object of the present invention to achieve a control in the straightening and in the direction of the fibers with respect to their flow path, and near to the collecting surface as is possible. In contrast with other systems wherein which it was attempted to straighten the fibers in an early stage of their flow path, as for example within the feed channel or at the time the fibers are torn from the roving, the present invention intends to effect the straightening and orientation as close to the collecting surface as possible. In the contrasted systems, the fibers would still have to overcome a rather long space or distance between the time they are straightened and the time they reach the spinning chamber. Thus, the danger of creasing or curling the fibers due to local conditions, e.g. frictional engagement with the wall of the feed channel, would still exist. According to the present invention the fiber is acted upon immediately before entering the spinning chamber, and at that point the direction of the movement of the fiber is changed and a sufficient inertia is applied to provide the desired result. Further, upon entering the spinning chamber, the character of the air flow in which the fibers are borne, is radically changed since the fibers, after leaving the feed channel, are subdued and subsidiary to the intensive action of a transverse flow of air, caused by the rotation of the spinning chamber. As a result, the fiber would impact or, come into contact with the inclined wall of the spinning chamber whereon because of the friction between the fiber and the side wall the velocity of the fibers is considerably increased, prior to deposition on the collecting surface.

In those constructions wherein the open end spinning unit is provided with a dividing means between it and the feed channel, the fiber is intended, according to the present invention, to be directed onto the inclined wall of the spinning chamber after first engaging the dividing means. In this manner it is possible to influence the fiber to such a degree as to achieve straightening at this point, thus making it possible for the fiber to reach the collecting surface of the spinning chamber in a high degree of orientation and straightness.

The present invention is therefore directed to the method and apparatus for achieving a controlled inlet of the fibers onto the sliding wall of the spinning chamber and for straightening the fibers to a maximum degree so that they may be subsequently deposited in this condition onto the collecting surface. As a result, yarn of higher quality will be attained.

The foregoing objects, and advantages, together with numerous other objects and advantages will be seen and appreciated from the following description of the present invention and the means for carrying the present invention into practice.

SUMMARY OF THE INVENTION

According to the present invention, the fibers are contacted by directing means located in the space between the end of the feed channel and the spinning chamber which directing means act to brake the ends of the fibers, in the direction of rotation of the spinning chamber so that the front ends of the fibers are deposited first on the inclined side wall of the spinning chamber.

According to the present invention, the front ends of the fibers are, by action of the direction means, deposited onto the inclined wall of the spinning chamber along a path which passes through a plane nearer to a plane laid through the collecting surface of the spinning chamber than the plane at which the rear ends of the fibers are deposited onto the inclined wall by the action of the same directing means. That is to say, with respect to the axial direction of the spinning chamber, the fibers enter the spinning chamber oriented with their front ends first.

Furthermore, according to the present invention, the directing means for orienting the fibers act to prevent the displacement of the rear ends of the fibers, in the direction of rotation of the spinning chambers. Thus, the front ends of the fibers move into the rotational orbit of the chamber, while the rear ends are withheld until the fibers are axially elongated. Preferably, the direction means are such that the rear end of the fibers embrace and engage, at least partially, the directing means, so as to hold them for a period of time sufficient to accomplish this.

According to the present invention, apparatus may be provided wherein the directing means are formed on the circumference of a divider or dividing means located between the mouth of the feed channel and the spinning chamber or the directing means may be located at the mouth of the feed channel itself. The directing means may take the form of inclined surfaces, prisms, directional recesses or grooves, pins, needles, or the like. The directing means may also be formed by at least a portion of one wall of the feed channel or by forming the profile of the mouth or outlet end of the feed channel appropriately to effect the positive orientation of the fibers.

Full details of the present invention are set forth in the following description of both the method and the apparatus. The description makes reference to the accompanying drawings showing the preferred embodiments of the apparatus for carrying out the method.

BRIEF DESCRIPTION OF DRAWINGS

In the drawings:

FIG. 4 is an axiometric view of a divider having means for directing and orienting the fiber;

FIG. 5 is an axiometric view, similar to FIG. 4, showing another form of divider with means for directing the flow of fiber;

FIG. 9 is an axiometric view of a portion of the spinning chamber and the end of the fiber feed channel employing a modified form of directing means;

FIG. 10 is a view similar to that of FIG. 9 showing still a further embodiment of the directing means.

DESCRIPTION OF THE INVENTION

Figure 1:
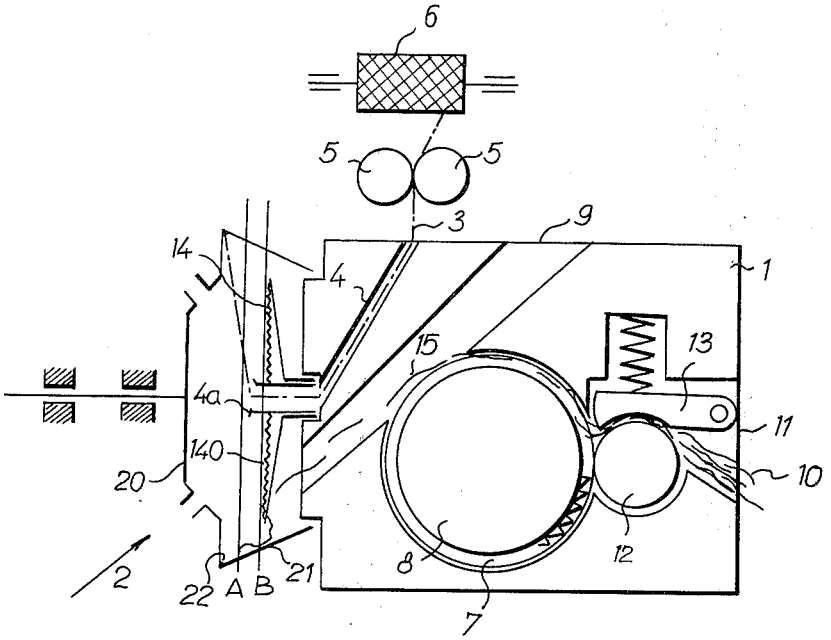
FIG. 1 is a side elevational view, partially in section, of an open end spinning unit, embodying the present invention.

Both the method and the apparatus of the present invention are described herein simultaneously. The present invention is applied to a generally conventional, open end spinning unit, schematically shown FIGS. 1 and 6. Such an open end spinning unit comprises a parallelepiped body, generally defined by the numeral 1, having a channel network formed within it for feeding a continuous stream of fibers 15 through the peripheral edge of a cup-shaped rotating spinning chamber, generally depicted by the numeral 2. The fibers are spun and twisted into the chamber 2 into a yarn 3 (dot-dash line) which is withdrawn through a duct 4 by a pair of contra-rotating pull or knit rollers 5 whereupon it is wound upon a bobbin 6.

Figure 6:
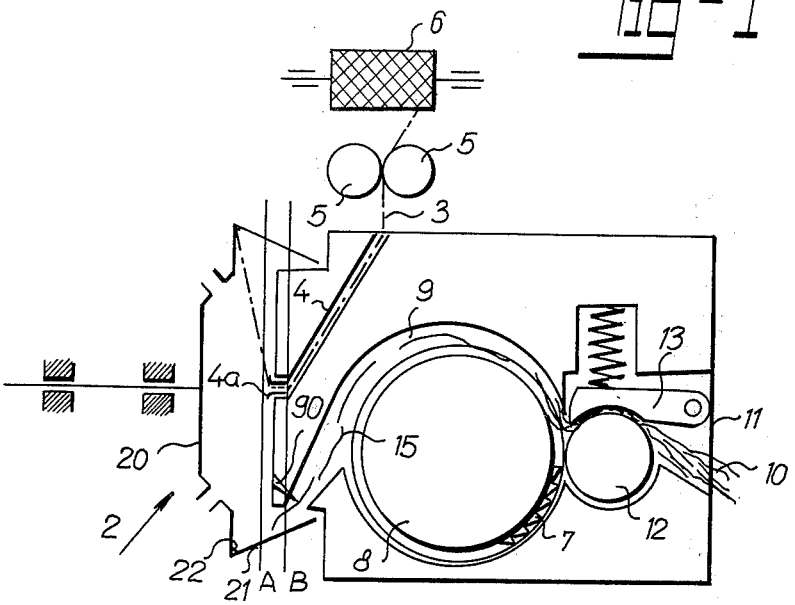
FIG. 6 is view similar to that of FIG. 1 showing the use of directing means formed within the feed channel.

A shallow cylindrical cavity 7 is formed in the center of the body 1 and a picker roller 8 is mounted therein to rotate about an axis which runs angularly to the axis of rotation of the spinning chamber 2. The picker roller 8 is provided with a saw-tooth, or similar circumferential edge so as to easily engage the fibers 15. Running tangentially to the picker roller 8 is a feed channel 9 which is directed linearly to the peripheral edge of the cup-like chamber 2 and opens upwardly out of the top surface of the body 1 to atmosphere. The picker roller 8 is rotated counter-clockwise as seen in FIGS. 1 and 6. A roving of fibers, depicted by the numeral 10, is supplied to the body through a channel 11. A feed roller 12, set in a cylindrical cavity adjacent the picker roller 8, carries the roving 10 to the picker roller 8. The feed roll 12 is provided with a counter-pressure plate 13 pivotally mounted and provided with a spring bias so as to hold the roving 10 firmly against the feed roller. The feed roller 12 also rotates counter-clockwise carrying the roving toward the picker roller 8 and the pressure plate is provided with an end so that the saw-tooth circumferential edge of the picker roller 8 is caused to tear the fibers from the roving 10 and carry them into the feed channel 9.

The spinning chamber 2 comprises a cup-shaped body having a rear wall 20 and a radially inwardly inclined skirt or side wall 21. The corner formed between the rear wall and the side wall, 20 and 21 respectively, form an annular interior collecting surface 22 in which and on which the fibers are centrifugally twisted into the yarn 3. The spinning chamber is spaced from the frontal face of the body 1 and is arranged so that its open end surrounds the mouth of the feed channel 9. A withdrawal tube 4*a* is fixed in the body 1, along the axis of rotation of the spinning chamber 2 and in communication with the duct 4 so that the yarn 3 is withdrawn from the center of the spinning chamber after its formation in the annular circumferential collecting surface 22.

In general the construction thus described is conventional. Because of this fact, the description and drawings omit various details, or shows such details schematically, for the sake of brevity. Such means as the means for bearing and rotating the spinning chamber, rotating the picker and feed rollers, and for rotating the withdrawal rollers 5 and bobbin 6, fall within this category. The drawings, however, more clearly depict apparatus for carrying out the present invention and for providing means for orienting and directing the flow of fibers from the feed channel directly on to the inclined slide surface or side wall 21 of the spinning chamber so that a more homogeneous, uniform and cohesive yarn may be spun.

In the embodiment of the present invention, illustrated in FIG. 1, an annular divider 14 is located between the rear wall 20 of the spinning chamber and the front face of the body 1. The divider 14 is provided with a hole in its center and is mounted coaxially about the withdrawal tube 4a. The divider 14 has an outer diameter sufficiently enlarged to extend beyond the outward or mouth of the feed channel 9 so that the fibers, depicted by the numeral 15, may be engaged by it as the fibers leave the channel 9. Arranged along the peripheral edge of the divider, at least in part near the mouth of the feed channel 9, are a plurality of spaced fiber orienting and directing means which act to divert the fibers 15 from their generally linear flow into the chamber 2 into a generally radially direction onto the inclined side wall 21 on which they are caused to slide by the rotation of the spinning chamber onto the collecting surface 22. The fibers 15 reach the collecting surface 22 uniformly oriented in spatially arranged flow where they may be more uniformly spun.

Figure 2:
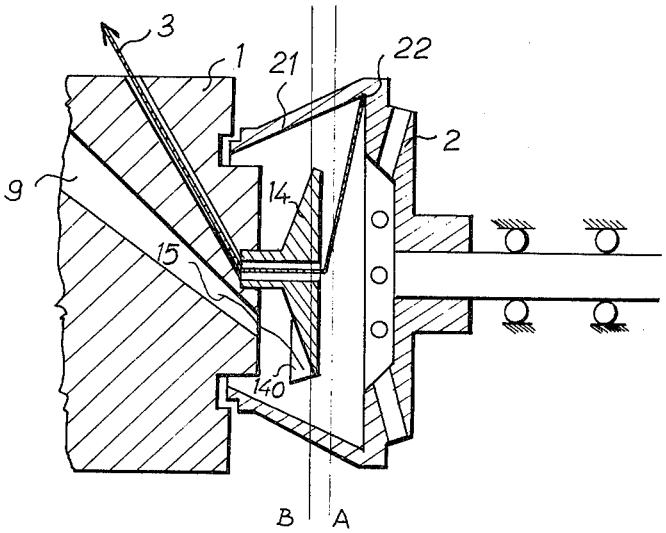
FIG. 2 is an enlarged view, similar to that of FIG. 1 showing another embodiment of the present invention.
Figure 3:
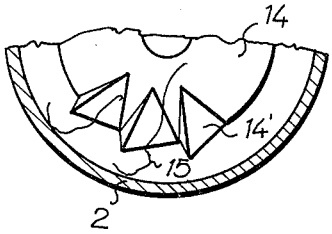
FIG. 3 is a detailed view of a portion of a divider on which the directing means for carrying out the present invention are formed.

The divider 14 may be either a circular disk having a continuous unitary body or it may be an annulus interrupted about its circumference. The means for orienting or directing the flow of the fiber may take any one of a variety of forms. In FIG. 2 these means may comprise inclined surfaces 141 or as seen in detail in FIG. 3 prism-like members. The divider 14 may be made separately from the withdrawal tube 4*a*, as seen in FIG. 1, or unitarily with the withdrawal tube, as seen in FIG. 2. The means for directing and orienting the fibers may also be formed as a a series of radial grooves 140, as seen in FIG. 1 or as a scalloped edge 142 as seen in greater detail in FIG. 4. Alternately, small pins, nails or needles 143, as seen in detail in FIG. 5, may also be used. The means 141, 142 or 143 may be arranged about the entire circumference of the divider, as seen in FIG. 5, or only about a portion of it, as seen in FIG. 4.

Figure 7:
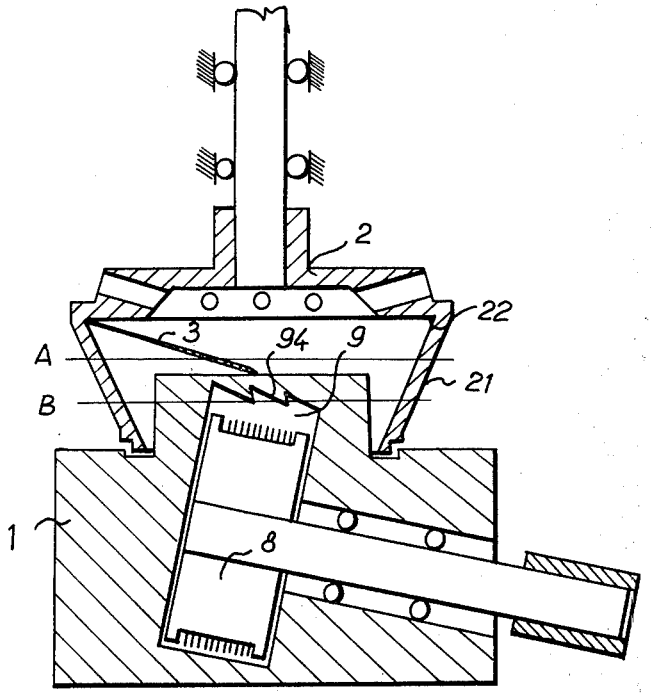
FIG. 7 is an enlarged view, in section, showing a feed channel having modified means for directing the flow of fiber.
Figure 8:
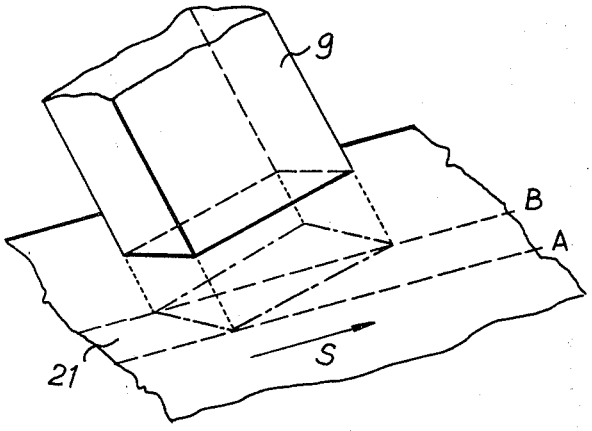
FIG. 8 is a projection of the exit end of the feed channel having a defined zone adjacent the inclined wall of the spinning chamber by which the fibers are directed thereon.

In the embodiment of the invention, illustrated in FIG. 6, a divider is not used but the feed channel 9 is itself provided with means for directing and orienting the fiber and is modified so that its outward end points directly onto the inclined side wall 21 of the spinning chamber 2. It is noted that because of the divider 14 used in the embodiment of FIG. 1 the direction of the feed channel directly onto the sliding wall is not required. With the embodiment illustrated in FIG. 6 the means for orienting and directing the fibers are located directly at the outlet end or mouth of the feed channel 9 and may take the form of projections such as pins 91 (as seen in detail in FIG. 9), needles 92 (as seen in detail in FIG. 6), or by the formation of recesses or longitudinal grooves 93 (as seen in detail in FIG. 10). It is also possible to provide the outlet end of the feed channel 9 with inclined surfaces such as prisms (as seen in detail in FIG. 7) or with an inclined surface formed at least in part by one wall of the channel 9 which acts in cooperation with the inclined side wall 21 of the spinning chamber 2 (as seen in detail in FIG. 8).

In either embodiment illustrated in FIGS. 1 or 6 or in either form for the directing means, the general operation of the open end spinning machine is the same. The roving fibers 10 is fed to the feed roller 12 wherefrom the counter-clockwise picker roller 8 separates and opens the fibers throwing a substantially endless flow of discrete individual fibers into the channel 9 toward the spinning chamber. In the embodiment of FIG. 1 the opened fibers are caused to impinge first on the divider 14 and thereafter are centrifugally cast onto the inclined side wall 21, sliding therefrom into the corner forming the collecting surface 22, whereupon they are then twisted and formed into an endless ribbon of yarn which is continuously withdrawn through the withdrawal tube 4a. During this process the fibers 15, leaving the outlet of the channel 9, are caused to impinge upon the surface of the divider 14 and to move radially outward therefrom changing their general axial direction of movement to a more radial direction. As soon as the fibers 15 reach the outer peripheral edge of the separator, they come into contact with the orienting means. Be they the inclined surfaces 141, grooves 142 or projections 143, the ends of the fibers 15 partially embrace the orienting means and are sufficiently braked so that the displacement of the rear end of the fiber 15 in the direction of rotation of the spinning chamber is sufficiently prevented. The fibers are thus frictionally acted upon and straighten themselves out so as to elongate themselves in the direction of the flow path.

As seen in FIG. 1, the location of the divider having the orienting means at its circumferential end engages the fibers and allows the front end of the fibers to come into contact with the inclined side wall 21 along an imaginary plane A (perpendicular to axis of rotation) which is closer to the collecting surface 22, while it sufficiently retards the rear ends of the fibers 15 so that they are deposited on the side wall 21, after the front ends of the fibers along a parallel imaginary plane B which is further from the collecting surface 22 then is the plane A. In this way, the fibers are elongated and stretched, removing any curl or crease which was created in the roving or during the picking. The fibers are so deposited on the inclined side wall 21 so that when collected and spun in the collecting surface 22 a more uniform yarn, having higher strength, feel and cohesiveness as well as other improved properties is obtained.

A similar situation occurs in the use of the embodiments shown in FIGS. 6 – 10, even though the orienting and directing means are mounted directly at the exit of the feed channel 15. Whether the directing means is in the form of projections, such as pins 91 (FIG. 9), needles 92 (FIG. 6) or grooves 93 (FIG. 10) or by suitably profiling the form of the inner wall 94 (FIG. 7) the rear ends of the fibers 15 partially embrace the directing means and are retarded by them so that the front ends move forwardly into the spinning chamber and thus become elongated and straightened in the direction of rotation of the spinning chamber 2.

Further, according to the embodiments shown in FIGS. 6–10 the front ends of the fibers 15 come into contact with the sliding wall 21 also in an imaginary plane A, which is situated nearer to the plane of the collecting surface 22 while the rear ends of the fibers are deposited on the sliding wall 29 in a plane B parallel to the plane A but situated at a longer distance from the rear wall of the spinning chamber, i.e.: the plane of the collecting surface 22.

The common feature of all the orienting and directing means of the present invention, whether situated on a divider 14 or at the exit of the feed channel 9, consists in that the fibers are caused to have a transverse flow upon their entrance from the feed channel 9 into the spinning chamber 2 and frictionally slide along the inclined wall 21 before entering into the collecting surface 22. This causes the front ends of each of the fibers 15 to bend in the direction of rotation of the spinning chamber and to accelerate to the circumferential speed of the chamber, as a result of which the rear ends of each of the fibers 15 are caused to follow a path which is different from that of the front ends and which thus becomes deflected from the path in which they are flung through the feed channel 9. The rear ends of the fibers 15, which are opened by the picker roller 8 and which move through the channel 9, come into contact with the orienting and directing means at the inlet of the spinning chamber. It is noted, in FIG. 6 at least, that the feed channel 9 is elongated so as to enter directly within the mouth of the spinning chamber. The opened fibers are braked by the orienting and directing means so as to be straightened and deposited directly in the straightened condition on the inclined wall 21 without having to traverse an extended space between the mouth of the feed channel and the sliding wall.

At the moment at which the opened fibers 15 enter into the spinning chamber 2, only the front end of the fiber does so while the rear end, or possibly even the central part, of the fiber remains engaged with the directing and feeding means either in the feed channel 9 or on the divider 14. For that reason, an intensive transverse air flow is caused to act upon the front ends of each of the opened fibers 15 and the fibers come into frictional contact with the inclined wall 21, rotating at high circumferential speed. The rotation of the spinning chamber is in the same direction as the transverse air flow. These two factors act upon the front ends of the fibers 15 at the point of their inlet into the spinning chamber in such a manner they prevent their displacement from the direction of rotation. The front ends of the fibers are, therefore, drawn by the accelerating environment into the spinning chamber 22 and are accelerated to the circumferential speed of the spinning chamber so that the greater portion of each of the fibers 15 enters into the spinning chamber before the rear end of the fibers become embraced by the orienting and directing means and are thus retarded in their movement. The partial embracement of the fibers 15 by the directing and orienting means is successively increased with a growing effect by the exertion of the transverse forces acting upon the front ends of the fibers as they enter the spinning chamber. Thus, as the front ends of the fibers are moved in the direction of rotation of the spinning chamber, the angle of embracement, of the rear ends of the fibers with the orienting and directing means, is increased. Thereupon the braking force increases in dependence of the gradual transfer of the active contact of the fibers 15 with the directing means, in the direction toward the rear ends of the fibers 15. The accelerating forces, acting inside the spinning chamber 2, cause a traction to be exerted upon the front ends of the fibers 15, pulling the fibers in the direction of rotation of the spinning chamber, while the braking forces are exerted by the directing means on the rear ends of the fibers. This pull and retarding force at both ends of the fibers act to straighten the fibers at the moment of the inlet into the spinning chamber 2. In view of that, the path about which the fibers 15 are moved along the inclined wall 21 into the collecting surface 22 is relatively short. Therefor, no undesirable recurling or recreasing of the fiber occurs and the fibers are deposited in the collecting surface 22 in the most optimal straightened condition.

The advantage of the method and apparatus of the present invention and its various modifications lies in the fact that only simple means are employed to effect the straightening of the fibers immediately upon their entrance into the spinning chamber 2. A minimum of modification of existing spinning units is required while a maximum effect and probability is obtained in transferring the fibers in a straightened condition onto the collecting surface. As a result, the fibers which are to be spun into the yarn are received on the collecting surface in such condition whereby the properties of the yarn are improved. Particularly, the number of yarn brakage is significantly decreased and the yarn produced has a higher strength and more uniform twist so that further processing of the yarn and its utility is greatly enhanced and increased over yarns made by conventional methods.

Various modifications have been shown in the foregoing description. Other modifications, changes and various embodiments will be obvious to those skilled in the present art. Accordingly, it is intended that the present disclosure be taken as illustrative only of the invention and not as limiting of its scope.

What is claimed:

1. An open end spinning machine comprising a housing having means including a stationary feed channel and means for providing a supply of discrete fibers through said channel to a spinning chamber formed with a rear wall and a radially inwardly directed inclined side wall defining a collecting surface, means for engaging said fibers located at the exit end of said feed channel adjacent the inlet of said chamber, said means having a profiled surface for changing the direction of movement of said fibers from that in said feed channel, and for directing the front end of said fibers transversely to the inclinded surface of said collecting chamber and restraining the rear end of each fiber, causing the deposition of each fiber in said chamber with their rear ends along a path spaced behind the front ends of said fibers in the direction of rotation of said chamber.

2. The apparatus according to claim 1 wherein said means for engaging said fibers comprises a dividing wall mounted between said feed channel and said chamber, the profiled surface being formed along at least a portion of its peripheral edge.

3. The apparatus according to claim 2 wherein said profiled surface comprises radial grooves formed on said dividing wall.

4. The apparatus according to claim 2 wherein said profiled surface comprises a plurality of projections extending from said dividing wall.

5. The apparatus according to claim 1 wherein said profiled surface comprises a plurality of inclined prism-like surfaces.

6. The apparatus according to claim 1 wherein said profiled surface includes a plurality of substantially longitudinal grooves formed in the end of said feed channel.

7. The apparatus according to claim 1 wherein said profiled surface includes inclined prism-like surfaces formed in the end of said feed channel.

8. The apparatus according to claim 1 wherein said profiled surface comprises projections extending outwardly from the surface of said feed channel.

* * * * *